US007963805B2

(12) United States Patent
Ko

(10) Patent No.: US 7,963,805 B2
(45) Date of Patent: Jun. 21, 2011

(54) LOW PROFILE CABLE ASSEMBLY

(75) Inventor: David Ko, Fullerton, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 71 days.

(21) Appl. No.: 12/570,150

(22) Filed: Sep. 30, 2009

(65) Prior Publication Data

US 2010/0081335 A1 Apr. 1, 2010

(30) Foreign Application Priority Data

Sep. 30, 2008 (CN) ..... 2008 2 0302308

(51) Int. Cl.
*H01R 9/03* (2006.01)

(52) U.S. Cl. ..... 439/656

(58) Field of Classification Search ..... 439/656, 439/496–497, 492, 355, 357–358
See application file for complete search history.

(56) References Cited

U.S. PATENT DOCUMENTS 6,273,753 B1 * 8/2001 Ko ..... 439/579
6,305,978 B1 * 10/2001 Ko et al. ..... 439/579
6,338,652 B1 * 1/2002 Ko ..... 439/579
6,648,668 B1 * 11/2003 Ko ..... 439/353
6,659,791 B1 * 12/2003 Ko et al. ..... 439/353
6,685,495 B1 * 2/2004 Ko ..... 439/353
7,052,327 B2 * 5/2006 Ko ..... 439/660
7,223,120 B2 * 5/2007 Ko ..... 439/492
7,530,839 B1 * 5/2009 Lee ..... 439/496
2007/0010124 A1 * 1/2007 Ko ..... 439/492
2008/0293292 A1 11/2008 Wu et al.

* cited by examiner

*Primary Examiner* — Jean F Duverne

(74) *Attorney, Agent, or Firm* — Wei Te Chung; Andrew C. Cheng; Ming Chieh Chang

(57) ABSTRACT

A cable assembly includes an insulation housing, a plurality of contacts, a plurality of wires and a spacer. The housing includes a mating portion, a pair of flat portions extending from two sides of the mating portion, and a receiving space formed between the two flat portions. Each of the contacts is received in the housing and has a rear surface. The wires are corresponding to the contacts and each wire is connected its corresponding contact. The spacer is attached to the housing and has a front surface attached to the rear surface of the contact. The spacer includes a plurality of slots received in the receiving space. And the wires are respectively received in the slots.

7 Claims, 5 Drawing Sheets

LOW PROFILE CABLE ASSEMBLY

BACKGROUND OF THE INVENTION

1. Field of the Invention

The present invention relates generally to a cable assembly, and more particularly to a low profile cable assembly used to transmit electrical signals between a liquid crystal display and a mother board.

2. Description of the Prior Art

Miniaturization is a trend for portable electronic devices. Thus, connectors, used in the portable electric devices, becomes thinner and smaller so as to meet the requirements. US Patent Publication No. 20080293292, published to Ko on Sep. 16, 2003, discloses a cable assembly. The cable assembly includes a housing, a plurality of contacts received in the housing, a plurality of wires connected to the contacts, and a spacer assembled with the housing and located behind the housing. Each of the contact has a stick interferentially touched to the housing to make the contact firmly fixed in the housing. However, when the cable assembly, which is firmly connected to a complementary connector, needs to be drawn apart from the complementary connector by a huge force, only-stick structure is not fit for the cable assembly for firmly fixing the contact to the housing.

Hence, in this art, a cable assembly to overcome the above-mentioned disadvantages of the prior art should be provided.

BRIEF SUMMARY OF THE INVENTION

A primary object, therefore, of the present invention is to provide a cable assembly having a contact firmly fixed on a housing thereof In order to implement the above object, the cable assembly comprises an insulation housing, a plurality of contacts, a plurality of wires and a spacer. The housing comprises a mating portion, a pair of flat portions extending from two sides of the mating portion, and a receiving space formed between the two flat portions. Each of the contacts is received in the housing and has a rear surface. The wires are corresponding to the contacts and each wire is connected its corresponding contact. The spacer is attached to the housing and has a front surface attached to the rear surface of the contact. The spacer comprises a plurality of slots received in the receiving space. And the wires are respectively received in the slots.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
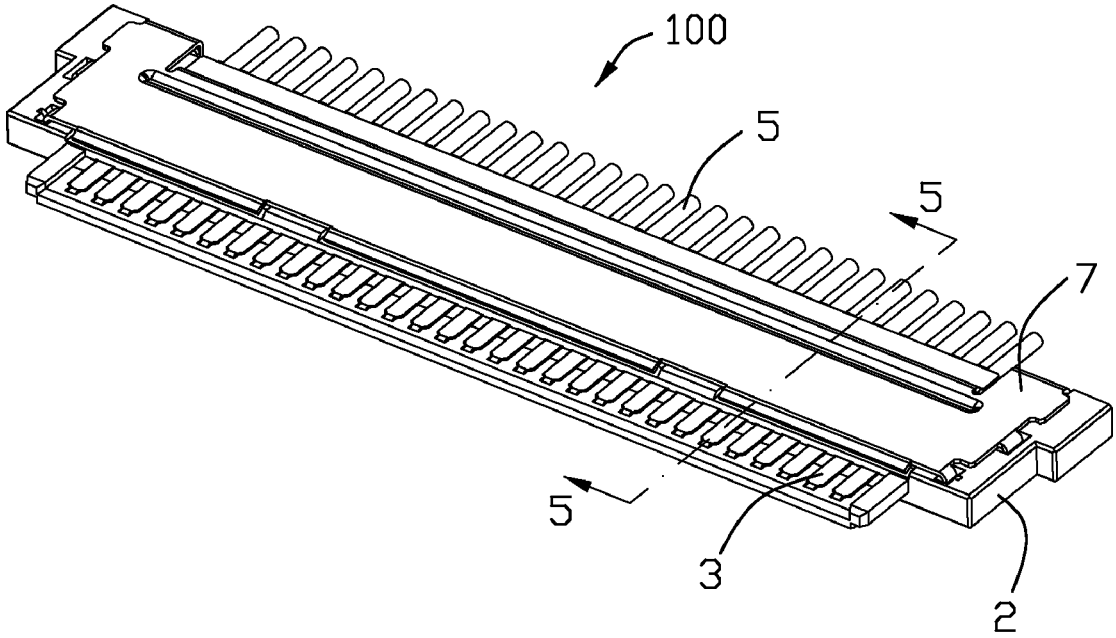
FIG. 1 is a perspective view illustrating a preferred embodiment of a cable assembly in according with the present invention.
Figure 2:
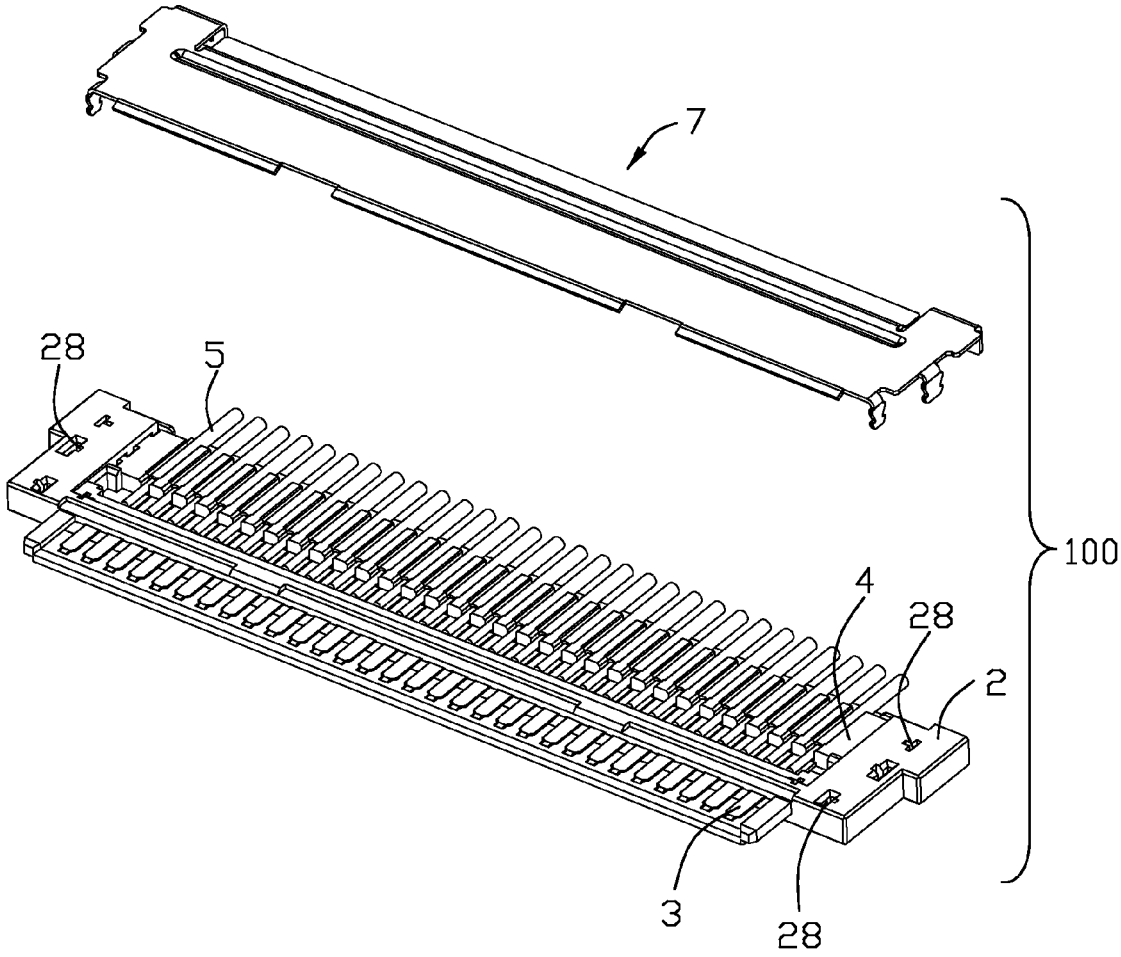
FIG. 2 is a partially exploded, perspective view of the cable assembly of FIG. 1.
Figure 5:
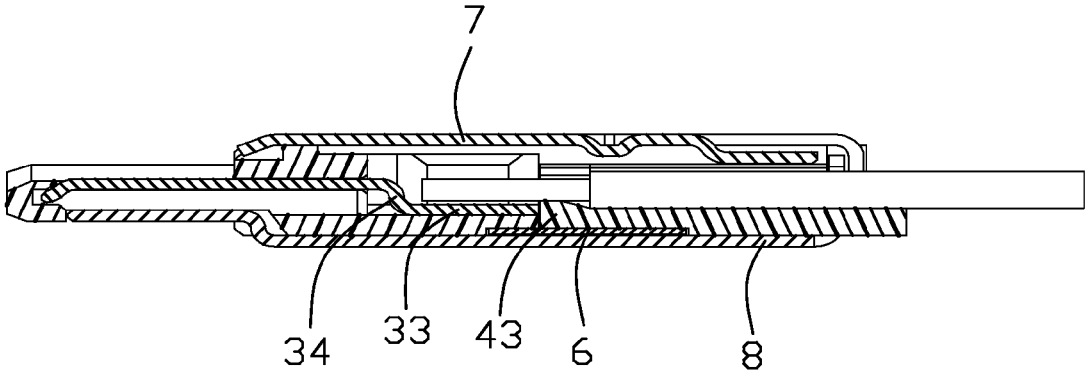
FIG. 5 is a cross-section view taken along line 5-5 of FIG. 1.

Reference to FIGS. 1, 2 and 5, a cable assembly 100 comprises an insulation housing 2, a plurality of contacts 3, a plurality of wires 5, a spacer 4 assembled on the rear portion of the housing 100 for receiving the wires 5, and a pair of shells which can be divided to an upper first shell 7 and a lower second shell 8.

Figure 3:
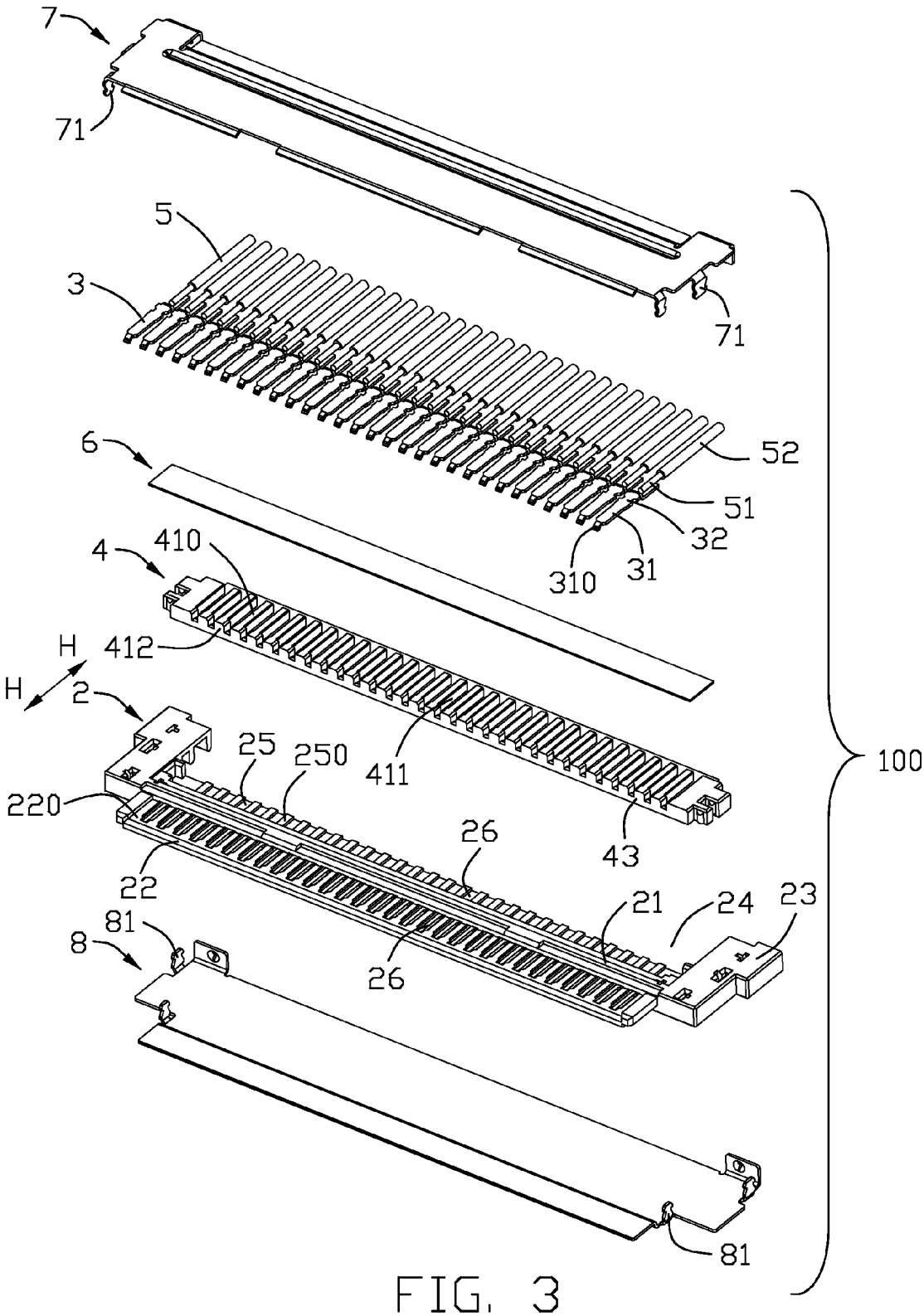
FIG. 3 is an exploded, perspective view of FIG. 1.
Figure 4:
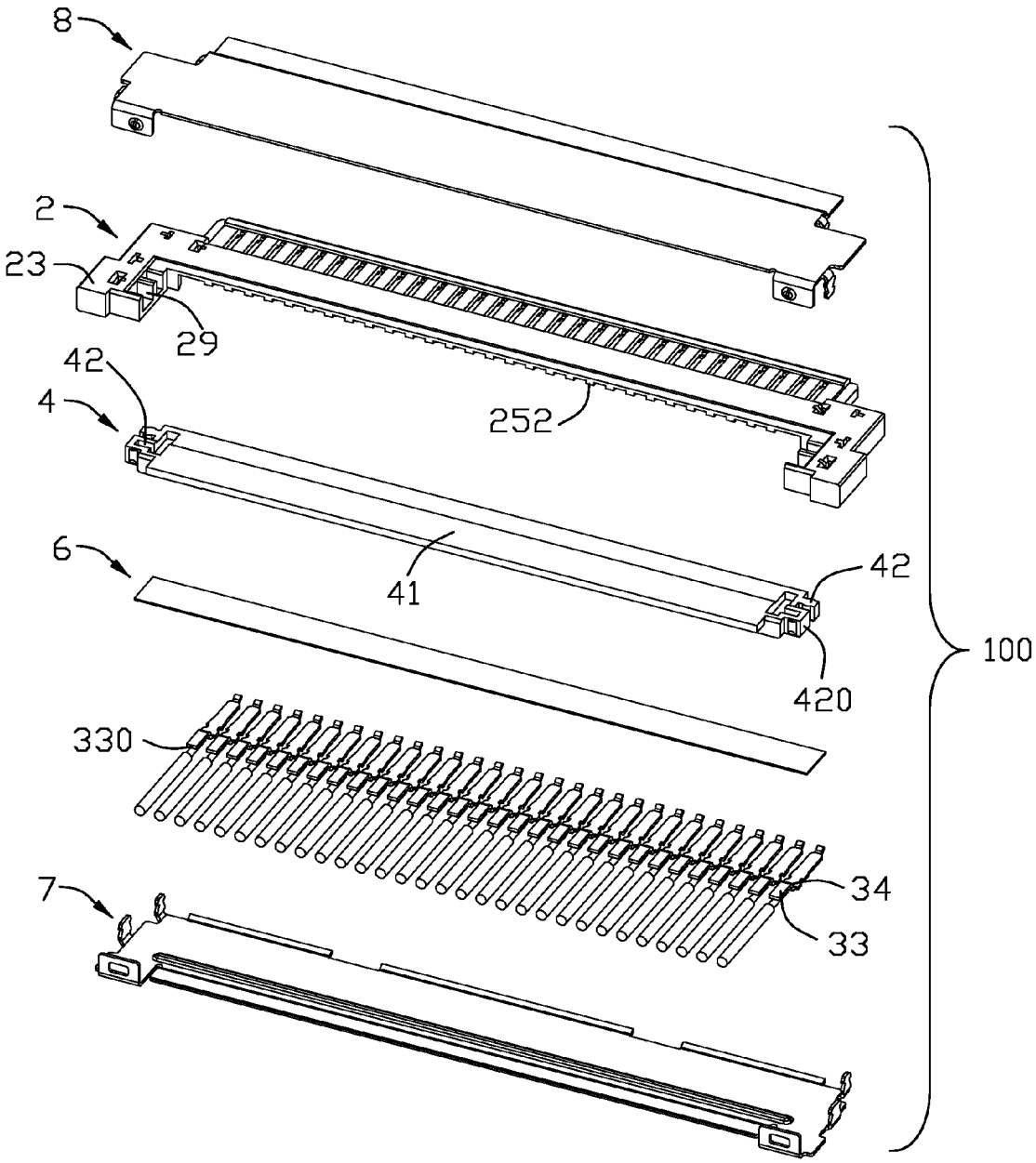
FIG. 4 is an exploded, perspective view similar to FIG. 3, but viewed from another angle.

Reference to FIGS. 3 and 4, the housing 2 comprises a crossbar 21 with a front, rear, and two side surfaces (not labeled), a mating portion 22 frontward extending from the middle of the front surface of the crossbar 21 to form a top surface 220, a pair of flat portions 23 rearward extending from the two side surfaces of the crossbar 21, and a supporting portion 25 rearward extending from the bottom of the crossbar 21. The crossbar 21 and the flat portions 23 forms a receiving space 24. The supporting portion 25 is received in the receiving space 24. And the supporting portion 25 has a top surface 250 higher than a top surface 220 of the mating portion 22 and a rear surface 252 facing to the receiving space 24. A plurality of passageways 26 is formed on the housing 2. Each of the passageways 26 extends along a front-to-rear direction and crosses the mating portion 22, the crossbar 21 and the supporting portion 25. The contacts 3 are respectively received in the passageways 26. Each of the flat portions 23 comprises a plurality of receiving holes 28 respectively arranged on upper and lower surfaces of the flat portion 23.

The contacts 3 are made from metal material. Each of the contacts 3 comprises a mating piece 31 respectively received in its corresponding passageway 26 on the mating portion 22, a middle piece 32 received in the crossbar 21, and a tail piece 33 received in its corresponding passageway 26 on the supporting portion 25. The mating piece 31 and the tail piece 33 are located on different planes and connected to each other via the middle piece 32, so that the middle piece 32 is formed like a ladder. The tail piece 33 has an rear surface 330 facing to the receiving space 24.

The spacer 4 is made from insulation material, and comprises a main body 41, a plurality of slots 411 arranged on the main body 41 and two pairs of fastening portions 42 respectively arranged on the two sides of the main body 41. The main body 41 has an front surface 412 facing to the supporting portion 25 of the housing 2. A plurality of ribs 410 are arranged on the main body 41, each of the ribs 410 is formed between each two slots 411 on the main body 41. Each of the slot 411 has a narrower front end and a wider rear end. Each of the wires 5 includes an inner conductor 51 and an insulation cover 52, and the inner conductor 51 pass through the narrower front end of the slot 41. The fastening portion 42 is a protrusion outward extending from the two sides of the main body 41. Correspondingly, the flat portion 23 comprises a pair of receiving grooves 29, so that each protrusion 42 is respectively interferentially received in its corresponding receiving groove 29.

Reference to FIGS. 3 and 5, the spacer 4 is assembled behind the supporting portion 25 to make the front surface 412 of the main body 41 attach to the rear surface 252 of the supporting portion 25. The spacer 4 further comprises an expanding portion 43 on the front end of the spacer 4. The front surface of the expanding portion 43 is attach to the rear surface 330 of the tail pieces 33 of the contacts 3 for protecting the contacts 3 broken away from the housing 2. Each of the inner conductor 51 of the wires 5 attaches to its corresponding tail piece 33 of the contact 3 for the inner conductor 51 easily soldered on the contacts 3. Each of the insulation cover 52 is arranged behind its corresponding expanding portion 43 instead of between each two of the expanding portions 43.

The cable assembly 100 further comprises an insulation tape 6. The tape 6 is approximately as long as the main body 41 of the spacer 4 and is stuck on the joint of the spacer 4 and the housing 2 for avoiding soldering tin flowing along a gap between the housing 2 and the spacer 4 to be electrically connected to the second shell 8. In other embodiment, the tape could also be stuck on the inner surface of the second shell 8 to cover the joint of the spacer 4 and the housing 2, while the tape 6 is not necessary for different soldering methods.

The first shell 7 and the second shell 8 respectively has a plurality of fastening arms 71, 81. The first shell 7 and the second shell 8 are respectively assembled on the housing 2 by the fastening arms 71, 81 being inserted into the receiving holes 26 of the housing 2.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cable assembly comprising:

an insulation housing comprising a mating portion, a pair of flat portions extending from two sides of the mating portion, and a receiving space formed between the two flat portions;

a plurality of contacts received in the housing and each having a rear surface;

a plurality of wires connected to the contacts; and a spacer attached to the housing and having a front surface attached to the rear surface of the contact;

said spacer comprising a plurality of slots received in the receiving space, said wires being respectively received in the slots.

2. The cable assembly as claimed in claim 1, wherein said spacer is fastened to the flat portions.

3. The cable assembly as claimed in claim 1, wherein said housing further comprises a supporting portion extending into the receiving space, and the supporting portion supports the contacts and provides space for contacts connecting to the wires.

4. The cable assembly as claimed in claim 3, wherein said cable assembly further comprises at least one first shell covering the spacer and the housing with an inner surface facing to the spacer and the housing.

5. The cable assembly as claimed in claim 4, wherein said cable assembly further comprises a tape, said tape is stuck on the joint of the spacer and the housing.

6. The cable assembly as claimed in claim 4, wherein said cable assembly further comprises a tape, said tape is stuck on the inner surface of the shell and covers the joint of the spacer and the housing.

7. The cable assembly as claimed in claim 1, wherein each of said slot of the spacer has a narrower front end and a wider rear end.

* * * * *